US006823564B2

(12) United States Patent
Gorman et al.

(10) Patent No.: US 6,823,564 B2
(45) **Date of Patent: *Nov. 30, 2004**

(54) PLASTIC CLIP CONSTRUCTION

(75) Inventors: Gregory P. Gorman, Clayton, NC (US); James S. Smith, Apex, NC (US)

(73) Assignee: Tipper Tie, Inc., Apex, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/659,459

(22) Filed: Sep. 10, 2003

(65) Prior Publication Data

US 2004/0045135 A1 Mar. 11, 2004

Related U.S. Application Data

(63) Continuation of application No. 10/164,439, filed on Jun. 6, 2002, now Pat. No. 6,637,075.

(51) Int. Cl.[7] ..... B65D 77/10
(52) U.S. Cl. ..... 24/30.5 R; 24/30.5 W
(58) Field of Search ..... 24/30.5 W, 30.5 R, 24/16 PB, 17 AP, 17 B, 115 H, 130, 33 L, 30.5 P; 383/71; 292/328, 325, 307 B, 320

(56) References Cited

U.S. PATENT DOCUMENTS

| | | | | | |
|---|---|---|---|---|---|
| 56,894 | A | * | 8/1866 | Brown | 24/30.5 R |
| 62,241 | A | * | 2/1867 | Wells | 24/16 R |
| 96,459 | A | * | 11/1869 | Melry | 24/134 R |
| 113,834 | A | * | 4/1871 | Balch et al. | 24/30.5 R |
| 182,771 | A | * | 10/1876 | Palmberg | 24/30.5 R |
| 353,246 | A | * | 11/1886 | Brooks | 292/320 |
| 712,765 | A | * | 11/1902 | Cole | 24/20 TT |
| 1,069,512 | A | * | 8/1913 | Adolphson | 24/31 R |
| 1,911,060 | A | * | 5/1933 | Greely | 292/307 R |
| 2,462,957 | A | * | 3/1949 | Gunn | 452/48 |
| 2,880,419 | A | * | 4/1959 | Tipper | 29/243.57 |
| 2,986,787 | A | * | 6/1961 | Ackermann | 24/28 |
| 3,152,350 | A | * | 10/1964 | Vosbikian | 15/229.1 |
| 3,184,817 | A | * | 5/1965 | Archer | 403/393 |
| 3,400,433 | A | * | 9/1968 | Klenz | 24/30.5 W |
| 3,530,544 | A | * | 9/1970 | Burniston | 24/16 R |
| 3,543,378 | A | * | 12/1970 | Klenz | 29/243.57 |
| 3,583,053 | A | * | 6/1971 | Hein | 29/709 |
| 3,584,347 | A | * | 6/1971 | Klenz | 24/30.5 W |
| 3,591,223 | A | * | 7/1971 | Castro | 292/260 |
| 3,721,750 | A | * | 3/1973 | Countryman | 174/135 |
| 3,744,096 | A | * | 7/1973 | Kok | 24/16 PB |
| 4,128,922 | A | * | 12/1978 | Hutchison | 24/30.5 R |
| 4,166,571 | A | * | 9/1979 | Niedecker | 383/71 |
| 4,275,485 | A | * | 6/1981 | Hutchison | 24/30.5 R |
| 4,370,778 | A | * | 2/1983 | Madsen | 24/30.5 R |
| 4,379,536 | A | * | 4/1983 | Mizuno et al. | 24/459 |
| 4,528,898 | A | * | 7/1985 | Sharp et al. | 454/61 |
| 4,557,023 | A | * | 12/1985 | Six et al. | 24/16 PB |
| 4,675,945 | A | * | 6/1987 | Evans et al. | 53/138.4 |
| 4,817,901 | A | * | 4/1989 | Kuo | 248/230.8 |
| 4,878,702 | A | * | 11/1989 | Madsen et al. | 292/307 R |
| 4,944,172 | A | * | 7/1990 | Evans | 24/30.5 W |
| 5,286,110 | A | * | 2/1994 | Benson et al. | 24/30.5 P |
| 5,544,391 | A | * | 8/1996 | Hoffman | 24/16 PB |
| RE36,544 | E | * | 2/2000 | Madsen et al. | 292/307 R |
| 6,047,448 | A | * | 4/2000 | Arnold | 24/16 PB |
| 6,070,304 | A | * | 6/2000 | Lii | 24/16 PB |

* cited by examiner

*Primary Examiner*—Robert J. Sandy
(74) *Attorney, Agent, or Firm*—Banner & Witcoff, Ltd.

(57) ABSTRACT

A two-part clip construction includes a U-shaped clip made from a plastic material with the legs of the clip spaced so as to fit over and then be deformed through a through passage in a leg locking member. The construction is especially designed to permit utilization of polymerics for forming the clips.

5 Claims, 4 Drawing Sheets

PLASTIC CLIP CONSTRUCTION

CROSS REFERENCE TO RELATED APPLICATION

This application is a continuation of Ser. No. 10/164,439 filed Jun. 6, 2002 now U.S. Pat. No. 6,637,075 entitled "Plastic Clip Construction" which is incorporated herewith by reference and for which priority is claimed.

BACKGROUND OF THE INVENTION

In a principal aspect the present invention relates to a clip construction for closure of packaging material and, more particularly, to a two-part clip construction wherein the components are preferably comprised of a polymeric material.

The use of metal and plastic clips that function as closures for bags and containers is well known. Many types of clips and/or straps are utilized to wrap or close the end of a bag or container. For example, metal clips may be formed about gathered bagging material as taught in U.S. Pat. No. 2,880,419 as well as U.S. Pat. No. 3,400,433. These patents, as well as U.S. Pat. No. 4,944,172 disclose generally U-shaped metal clips which are formed about gathered packing material by clip attachment machines. U.S. Pat. No. 4,528,898 is another patent showing a similar clip, as is U.S. Pat. No. 3,400,433. Various apparatus are used for attaching such clips about gathered casing material including apparatus as disclosed in U.S. Pat. Nos. 2,880,419 and 3,543,378 as well as U.S. Pat. No. 3,583,053 and U.S. Pat. No. 4,675,945.

Metal clips work quite well for closing and sealing gathered packaging material. However, the use of metal as a clip material has certain attributes which may not be desired. Thus, there has developed a series of products made from plastic or polymeric materials having the same or similar function to act as a closure. For example, Reissue U.S. Pat. No. 36,544 discloses a method and apparatus as well as a construction which employs a polymeric clip material comprised of a U-shaped clip member and a second gathering lock member which cooperates with the U-shaped member to hold a gathered neck of a package or container in the closed condition. U.S. Pat. No. 4,275,485 discloses yet another construction comprised of a single hinged clamp or sealing device used to close gathered packaging. Similarly, U.S. Pat. No. 4,128,922 shows a two-part sealing device or clamp for closure of the neck of a bag material which has been gathered.

There are numerous additional examples of both metal and plastic polymeric clip constructions comprised of a single piece or member or more than one member. Nonetheless, there has remained a desire and need for an improved plastic clip construction and, in particular, a plastic clip construction wherein the plastic material comprises a polymeric material.

SUMMARY OF THE INVENTION

Briefly, the present invention comprises a two-part clip construction including a first U-shaped clip member generally in the form of a typical staple and including a crown connecting first and second spaced legs. The legs are spaced a first uniform distance and the ends of the legs are generally coterminous. A second member of the construction includes a sealing block that includes a through passage connecting the opposite sides of the block. The opposite sides of the sealing block are spaced a lesser distance than the spacing of the legs. The legs are thus designed to fit over the sides of the block and be deformed or driven into the through passage between the opposite sides of the block. The legs thus bend and extend into the through passage from opposite sides of the block and are forced through the through passage. The legs are retained by the interactive friction thereof with the through passage in the block. The legs are effectively locked to the sealing block even though the surfaces of the legs and through passage are generally smooth, though they may be textured. The sides of the block member through which the through passage is defined are, in the preferred embodiment, more closely spaced one from the other than the terminal ends of the legs of the U-shaped clip member. This enables the ends of the U-shaped clip member to fit over the opposite sides of the block and then be deformed and pass through the through passage from the opposite sides of the sealing block. In a preferred embodiment, a single through passage is utilized to maintain the leg ends in the appropriate array and position overlapping one another side by side. However, the number of through passages is not considered to be a limiting feature of the invention. The sealing block itself, as well as the U-shaped clip, are preferably a polymeric material; however, other materials, including metal materials, may be used in particular, for the clip. Nonetheless, the clip is preferably a polymeric material and comprises a uniform cross section rod. Again, the material may be varied, however. Importantly, the material is generally plastic and deformable (i.e. plastic) and thus may be subjected to strain which forces the ends of the clip through the through passage of the block member.

The clip construction is capable of being utilized in clip attachment machinery that has been modified by various modifications to existing prior art machinery thereby enabling use of the clip of the invention with modified prior art equipment. More specifically, the clips are fed through a channel about gathered packing material. The gathered material is positioned between the clip legs adjacent the crown of the clip. The clip is driven downwardly against an anvil in a manner which then plastically deforms the legs through the through passage of the leg locking member. The leg locking member is fitted in the anvil at the end of the channel which feeds U-shaped plastic clips thereto. The locking member thus is positioned on or in an anvil intermediate the spaced legs of the U-shaped clip member which is driven down the clip channel. The anvil includes a separate guide slot for receiving each of the legs and for directing the legs simultaneously in opposite directions through the through passage of the leg locking member. The top of the leg locking member or sealing block is positioned opposite the crown of the clip member and is preferably shaped in a fashion which will accentuate the sealing characteristics of the closure construction. For example, the top surface of the leg locking member may be arcuate or convex. It may also be partially convex with a center recess or it may include serrations or other design features which will enhance the holding capability of the clip closure construction. Thus, the clip construction of the invention which is comprised of two elements can be easily incorporated with and used with clip attachment mechanisms of the type depicted by the prior art modified in a manner which will uniquely enable attachment of the disclosed clip construction about gathered packaging material.

Thus, it is an object of the invention to provide an improved clip construction.

It is a further object of the invention to provide an improved clip construction which may be incorporated with modified clip attachment mechanisms of the type generally utilized for packaging purposes for U-shaped metal clips.

Yet another object of the invention is to provide a two-part clip construction wherein a U-shaped plastic polymeric clip member is cooperative with and can engage a leg locking member or sealing block member by deformation of the legs of the clip member in opposite directions through a through passage in the leg locking member.

Yet a further object of the invention is to provide a two-part clip construction which may be manufactured from polymeric materials as well as non-polymeric materials and which preferably can be made from polymeric materials.

Another object of the invention is to provide a cost effective, easily applied clip construction capable of being placed around gathered packaging material and retaining that gathered packaging material by sealing the gathered packaging material.

Another object of the invention is to provide a closure made from a material, such as a polymeric material, that will readily pass through x-ray detection equipment without actuation. This allows the producer of such packages to test for foreign metallic objects other than the clip.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENTS

Figure 1:
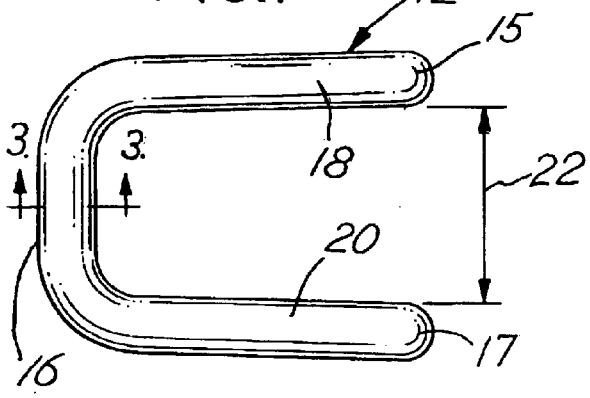
FIG. 1 is a plan view of the U-shaped first clip member of the clip construction.
Figure 3:
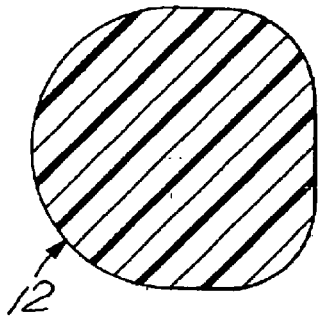
FIG. 3 is a cross sectional view of the first clip member of FIG. 1 taken along the line 3—3.
Figure 2:
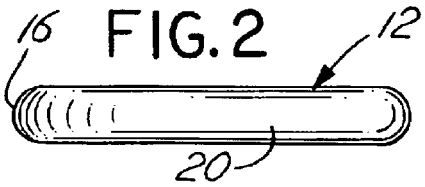
FIG. 2 is a side elevation of the clip of FIG. 1.
Figure 7:
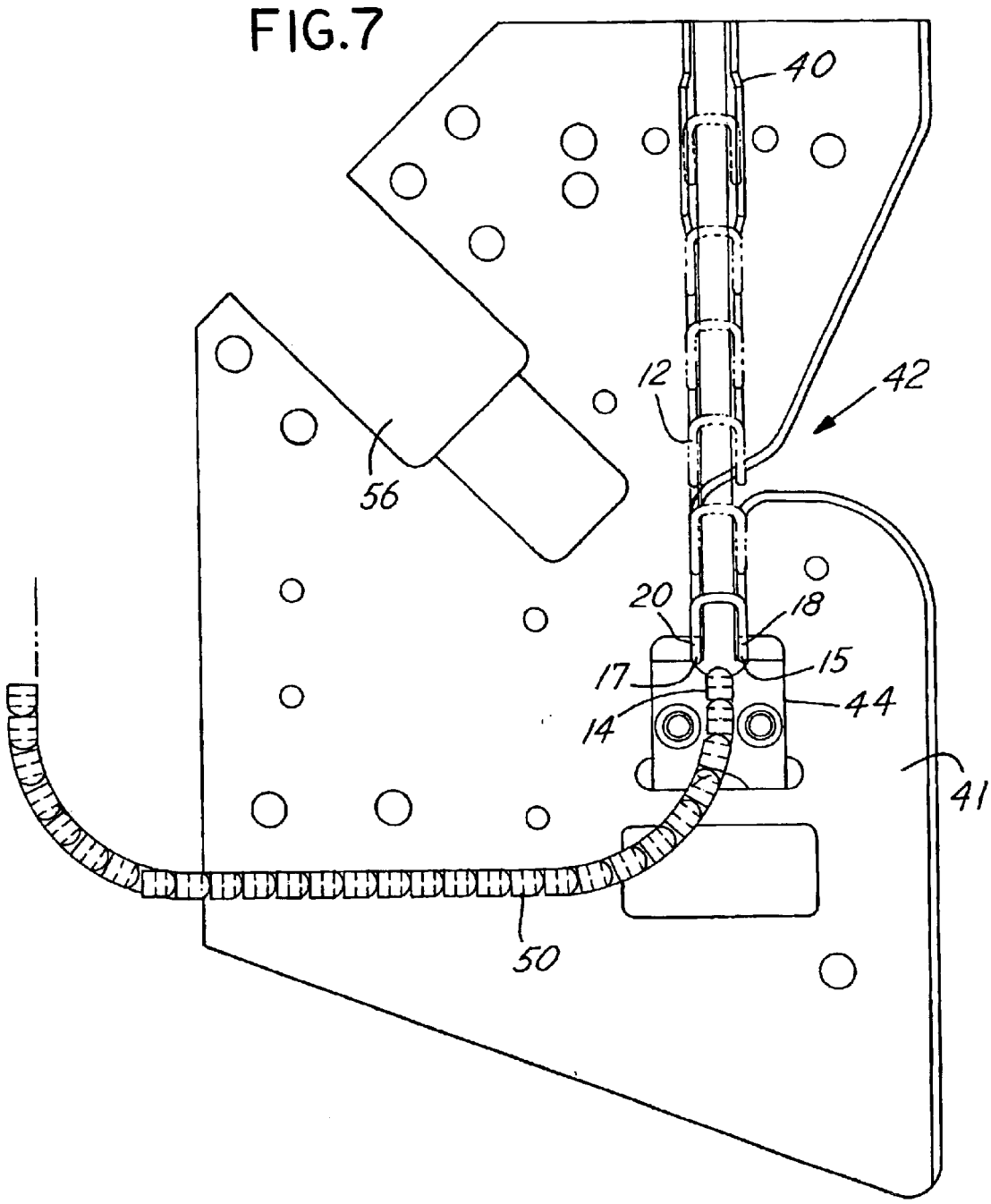
FIG. 7 is a side schematic view of a clip attachment mechanism utilized for attachment of the clip of FIGS. 1–6 about gathered clip material.
Figure 8:
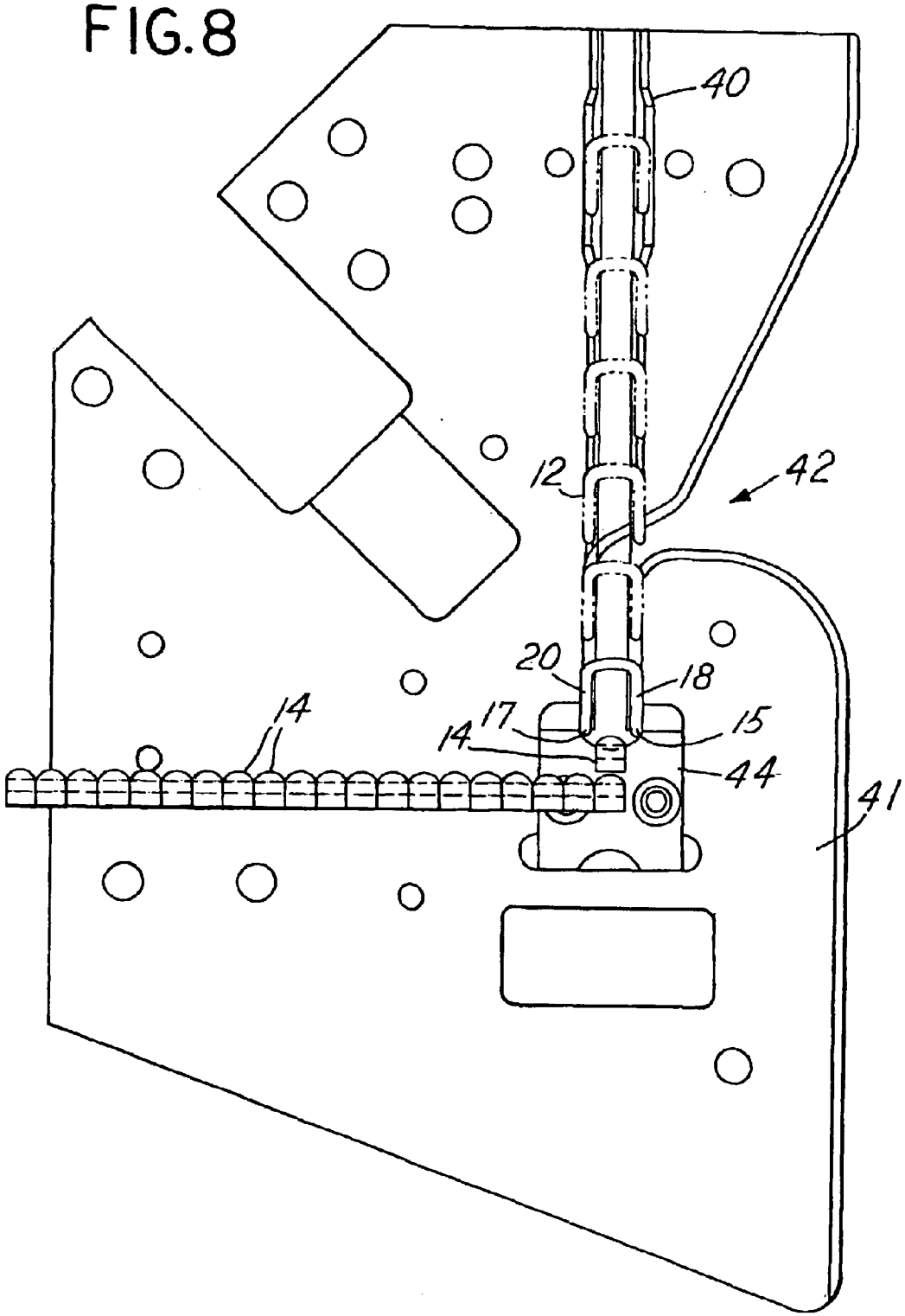
FIG. 8 is a side diagrammatic view of a clip attachment assembly that is an alterative construction to that depicted in FIG. 7.
Figure 9:
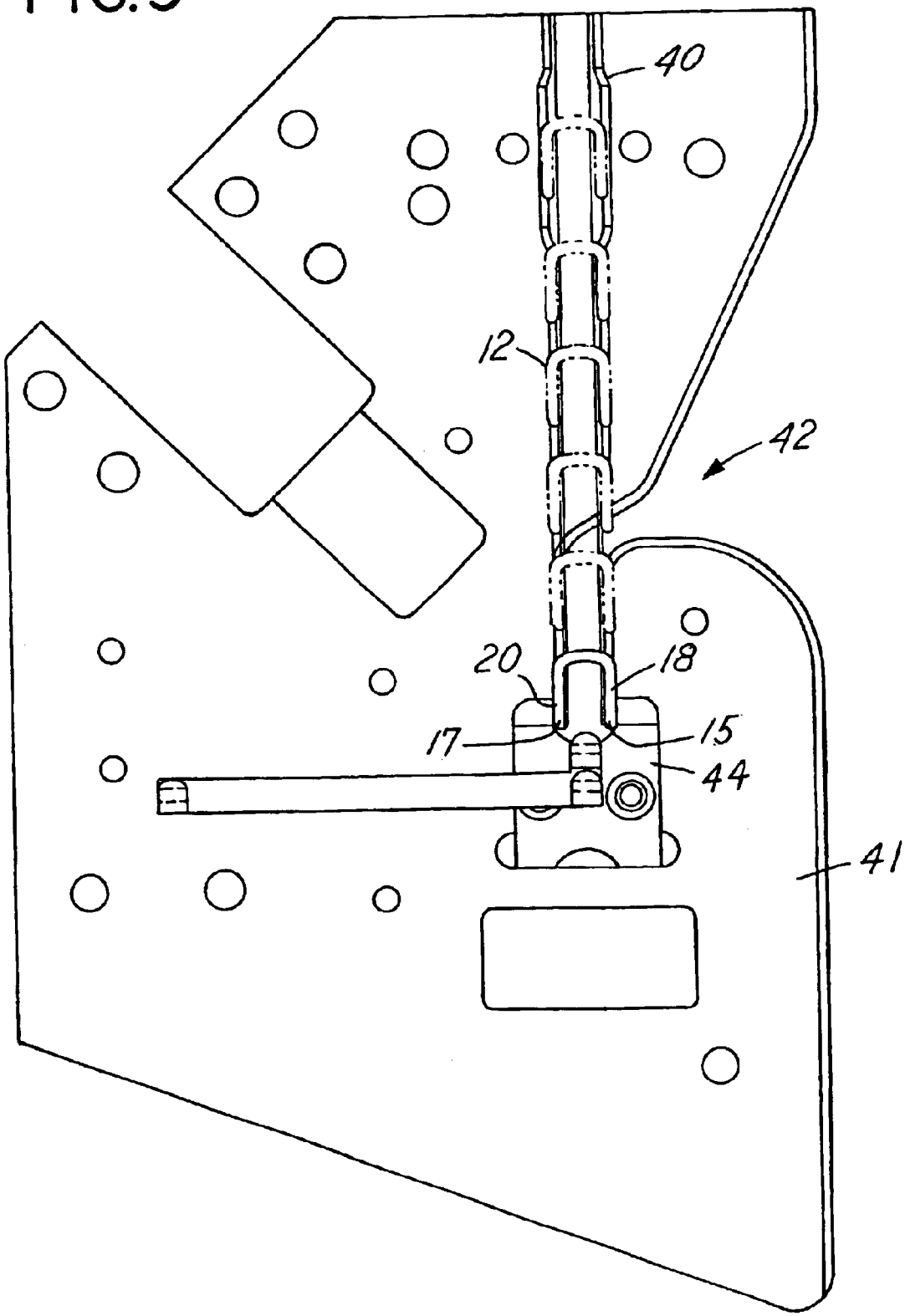
FIG. 9 illustrates a third alternative embodiment for a clip attachment mechanism associated with or used with the clip construction of the invention.

FIGS. 1–6 illustrate the clip construction which includes a first U-shaped clip member 12 and a second leg locking member lock or sealing block member 14. The first U-shaped clip member 12 includes a crown 16 connecting a first leg 18 and a second leg 20. Preferably, the cross section of the clip member 12 is uniform as depicted in FIG. 3 along the entire length of the clip. The legs 18 and 20 preferably are of equal length and coterminous. The legs 18 and 20 are spaced one from the other having an inside spaced dimension or distance 22. The clip member 12 is generally in the form of a staple though other configurations may be utilized. Preferably, the clip member 12 will have a cross sectional configuration which is uniform as shown in FIG. 3. However, the configuration or cross sectional shape of the legs 18 and 20, as well as the shape and configuration of the cross section of the crown 16, may be varied. In a preferred embodiment, the legs 18 and 20 are generally divergent outwardly very slightly and are designed to slide in a clip channel as depicted in FIGS. 7, 8 and 9 driven by a punch impinging against the outside of crown 16.

Figure 4:
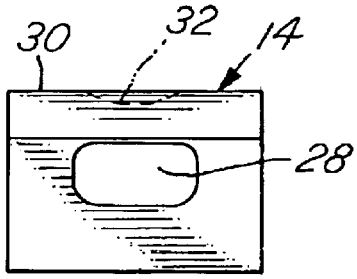
FIG. 4 is a side elevation of the leg locking member component, or element, of the two-part clip construction.
Figure 5:
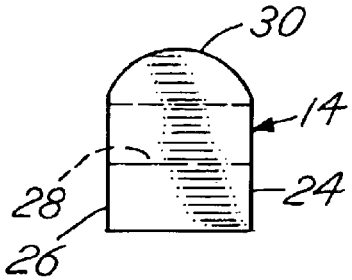
FIG. 5 is an end view of the leg locking member of FIG. 4.

The second part of the clip construction comprises the leg locking member 14. The leg locking member 14 includes, in a preferred embodiment, a first side 24 and a generally parallel, spaced, second side 26. A single through passage 28 is defined between the first and second sides 24 and 26. The through passage 28 is sized to simultaneously accommodate the legs 18 and 20 in side by side array as depicted in FIG. 4. The through passage 28 may therefore include guide sections or entry ramps associated with the through passage 28 so that the opposed legs 18, 20, as they bend, will be guided into the through passage 28.

In the preferred embodiment a single through passage 28 is provided to maintain the legs 18 and 20 in side by side, overlapping and constrained array as they are deformed and forced therethrough from opposite sides of through passage 28. However, separate through passages may be provided for each of the legs 18, 20. Separate through passages will still maintain the legs 18, 20 in generally side by side though spaced array and the clip construction will still be configured to grip or maintain packaging material between the crown 16 and the block 14.

Preferably, the block 14 includes an arcuate, convex domed top surface 30. The top surface 30, when the clip member and leg locking member are joined, will be opposed to the underside of the crown 16. The top surface 30 may have other configurations and may, in fact, include, for example, an indentation such as depicted in phantom as indentations 32 in FIG. 4. The surface 30 may also include serrations, grooves, etc. When assembled, the configuration surface 30 tightly grips gathered packaging material and holds the packaging material in a manner that will prevent the clip construction from slipping from the gathered packaging material.

Figure 6A:
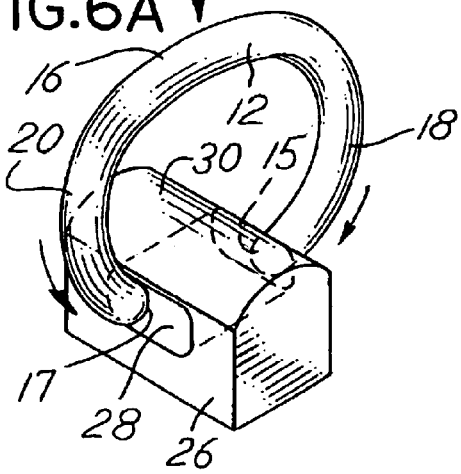
FIG. 6A is an isometric view of the two-part clip construction comprising the first U-shaped clip member and the separate leg locking member.
Figure 6B:
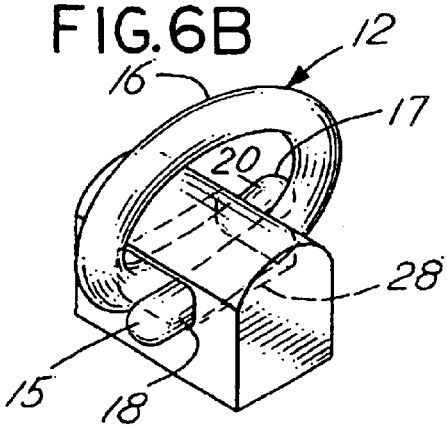
FIG. 6B is an isometric view of the clip construction of FIG. 6A wherein the parts are assembled.

FIGS. 6A and 6B illustrate the clip construction in two different configurations. In FIG. 6A the two separate members; namely, the first U-shaped clip member 12 is depicted positioned to be engaged with the through passage 28 by deformation from the opposite sides 24 and 26 of the block member 14. In FIG. 6B the components parts 12, 14 have been joined together in a manner which will retain gathered packaging material.

FIGS. 7, 8 and 9 illustrate various methods and devices for joining the two parts of the clip construction; namely, the clip member 12 and the leg locking member 14. In a manner which is analogous to prior art clip attachment mechanisms such as referenced in the Background of the Invention, the clips 12 are fed singly into a vertical channel 40 and driven downwardly by a punch 41 about gathered material that has been positioned through a neck opening 42 of a clip attachment machine or apparatus. The clip 12 and more particularly, the legs 18 and 20, will then fit about the gathered material carrying the gathered material downwardly in the channel 40. The ends 15 and 17 of the clip member 12 will then engage against arcuate slots or channels in an anvil 44 and be driven toward each other through the through passage 28 of the block member 14 supported in anvil 44. The block member 14 is fed upwardly through a channel 50 in the anvil support 91. The block member 14 thus is positioned in a manner which will enable the legs 18 and 20 to be plastically deformed and fit through the through passage 28 about the gathered material. A knife cylinder 56 can then cut the packaging material in a manner known by those skilled in the art and the component parts forming the package gathering mechanism will release the sealed package. The material, with the attached clip, will then be removable from the clip attachment mechanism.

In FIG. 8 the feed mechanism for the leg locking or block member 14 is varied. The anvil 44 includes a side passage rather than a lower end passage and the block member 14 is fed upwardly through the anvil from the side passage so as to expose the through passage 28 for engagement with the legs 18 and 20. FIG. 9 illustrates yet another configuration of such a mechanism. In all three mechanisms, the leg locking member 14 is fed through the anvil 44 upwardly to be positioned for the directed plastic deformation of the legs 18 and 20 by virtue of being driven against the anvil 44 and thereby deformed for movement through the through passage 28.

The particular configuration of the U-shaped clip member as well as the leg locking or block member 14 may be altered or varied. The material used to make these members may also be varied. For example, metal clips may be combined with polymeric materials. It is to be noted however, that the frictional engagement of the plastically deformed legs 18, 20 with the leg locking member 14 serve to form a sealed closure.

One of the important advantages of the invention is the fact that polymeric materials may be utilized to practice the invention. Various manufacturing and health authorities have suggested that the use of polymerics may be desirable particularly, for the processing of food, for example. Additionally, there may be a cost benefit. Typical polymerics which may be utilized in the practice of the invention.

It is to be noted that the invention may be varied without departing from the spirit and scope thereof. The invention, therefore, is to be limited only by the following claims and equivalents thereof.

What is claimed is:

1. A two part clip construction comprising, in combination:

a first U-shaped clip member including first and second spaced legs joined at one end by a connecting crown, each leg having an opposite free end with an inside, said insides of said free ends of said legs spaced a first distance, said first clip member formed from a deformable, plastic material, whereby the first clip member may be strained to form a generally closed loop shape having the legs arranged in an overlapping array with the leg ends extending in generally opposite directions; and a leg retention member for engaging the legs, said retention member comprising a block with first and second, spaced opposed sides and with a through passage between the opposed sides, said through passage defining openings on the opposite sides of the retention member, said openings spaced a second distance no greater than the first distance, said through passage sized and shaped to accommodate movement of the leg ends there through upon positioning the first and second free leg ends into openings respectively on opposed sides of the retention member and plastically deforming the first and second legs in overlapping array to thereby retain material gathered between the legs.

2. The construction of claim 1 wherein at least one of the members is a polymeric material.

3. A method for retaining gathered material comprising the steps of applying a two member clip construction to the gathered material, said clip construction comprising:

a first U-shaped clip member including first and second spaced legs joined at one end by a connecting crown, each leg having an opposite free end with an inside, said insides of said free ends of said legs spaced a first distance, said first clip member formed from a deformable, plastic material, whereby the first clip member may be strained to form a generally closed loop shape having the legs arranged in an overlapping array with the leg ends extending in generally opposite directions; and a leg retention member for engaging the legs, said retention member comprising a block with first and second, spaced opposed sides and with a through passage between the opposed sides, said through passage defining openings on the opposite sides of the retention member, said openings spaced a second distance no greater than the first distance, said through passage sized and shaped to accommodate movement of the leg ends therethrough upon positioning the first and second free leg ends into openings respectively on opposed sides of the retention member and plastically deforming the first and second legs in overlapping array to thereby retain material gathered between the legs by positioning the gathered material between the first and second leg members of the clip member;

positioning the retention member in alignment with the clip member by orienting the retention member with the openings aligned for receipt of the leg members;

directing the first and second leg members respectively into opposed side openings of the retention member; and plastically deforming the leg members to encircle the gathered material.

4. The method of claim 3 wherein the clip member is driven to engage a static retention member.

5. The method of claim 3 including a preliminary step of feeding and gathering material in alignment with a clip member and retention member.

* * * * *